United States Patent [19]

Krier

[11] 4,067,076

[45] Jan. 10, 1978

[54] UPHOLSTERED BODY

[75] Inventor: Philipp Krier, Stuttgart, Germany

[73] Assignee: Mirabed AG, Zug, Switzerland

[21] Appl. No.: 715,936

[22] Filed: Aug. 17, 1976

[51] Int. Cl.[2] ..... A47C 23/04

[52] U.S. Cl. ..... 5/351; 5/260; 5/360

[58] Field of Search ..... 5/351, 260, 261, 354, 5/355, 360, 361 B; 428/175, 300

[56] References Cited

U.S. PATENT DOCUMENTS

| | | | |
|---|---|---|---|
| 3,307,207 | 3/1967 | Cole | 5/354 |
| 3,665,530 | 5/1972 | Basner | 5/354 |
| 3,822,426 | 7/1974 | Mistarz | 5/351 |
| 3,956,783 | 5/1976 | Stoller | 5/355 |
| 3,981,033 | 9/1976 | Toda | 5/351 |

*Primary Examiner*—Casmir A. Nunberg

*Attorney, Agent, or Firm*—Walter Becker

[57] ABSTRACT

An upholstered body, especially mattress, with a spring core which is provided with at least one cover plate of elastic foam material, and has on at least two opposite sides thereof inwardly of the plate respectively arranged a marginal body member of elastic foam material. In the transition area between the cover plate or cover plates and the marginal body members on at least two oppositely located sides of the upholstered body, there are provided bend-elastic bar-shaped stiffening bodies which consist substantially of compacted synthetic foam material, preferably of the same type the marginal body members are made of and preferably integral therewith. These stiffening members are located at the inside of the adjacent cover plate. Interposed between the at least one cover plate and the adjacent ends of the springs is an intermediate layer having its marginal areas connected to the stiffening bodies.

11 Claims, 6 Drawing Figures

UPHOLSTERED BODY

The present invention relates to an upholstering body, especially a mattress with a spring core which is provided with at least one cover plate of elastic foam material on which cover plate is arranged a marginal part of elastic foam material which marginal part projects beyond the inner side of said cover plate, said marginal part together with the inner side of the cover plate defining a slot for engagement by end coils of the spring core.

An upholstering body of this type has been disclosed by German Offenlegungsschrift No. 2 354 618 according to which the marginal part which forms one piece with the cover plate engages between spring windings of springs of the spring core in order thereby to stiffen the marginal portion of the upholstered body. When the upholstered body is compressed, the windings or coils of the springs carry out relative movements with regard to each other which may damage the marginal parts extending between the windings. Also the cover plate, the inner surface of which engages in an unprotected manner the end windings of the spring coil may be damaged by the movements of the spring. Inasmuch as the cover plate and the marginal part consist of pressure elastic soft synthetic foam material and since the springs of the spring core are connected to each other by wires, a sufficient rigidity and form-retaining ability of the upholstered body within the marginal region is not assured. As a result thereof, the upholstering body buckles when the upholstering body is under a unilateral load for instance when it is under a load at the marginal region, and the cover for the form material is displaced relative to the spring core.

It is also known at the end of a spring core to provide a frame of band steel for stiffening the soft spring core. The weight of such frame, however, is rather great. Furthermore, the frame affects the elastic yieldability of the upholstering body and thus its adaptation to the respective loads.

It is, therefore, an object of the present invention so to design an upholstering body of the above mentioned general type that with a minimum of the total weight, the individual parts of the upholstering body are secured as to their positions relative to each other, and that the upholstering body will not buckle when it is under a load in the marginal region.

These and other objects and advantages of the invention will appear more clearly from the following specification in connection with the accompanying drawing, in which:

FIG. 1 diagrammatically illustrates, partially in section, a cutout of an upholstering body according to the invention.

Figure 3:
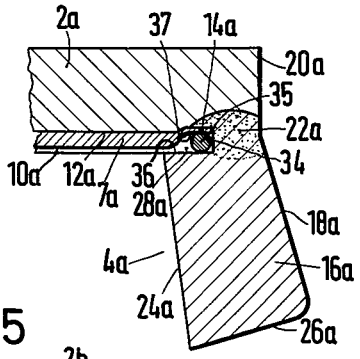
FIG. 3 represents a portion of the upholstering body according to FIG. 2 in released condition and on a larger scale than that of FIGS. 1 and 2.
Figure 5:
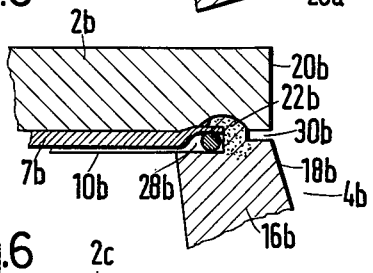
Figure 6:
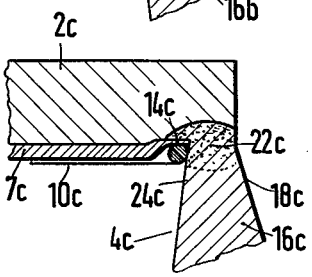

FIGS. 5 and 6 respectively illustrate two further embodiments of the invention in an illustration similar to that of FIG. 3.

The upholstering body according to the present invention is characterized primarily in that in the transition area between the cover plate and the marginal portion there are provided rod-shaped stiffening members located at least on two sides of the upholstering body which are located opposite to each other, said stiffening members being formed of hardened or compacted synthetic foam of the marginal part and are located below the outer surface of the cover plate in spaced relationship thereto, while to the stiffening members there are connected the marginal portions of an intermediate layer arranged on the inner side of the cover plate.

Due to the stiffening members consisting of synthetic foam which are embedded in the manner of inserts in the pressure elastic foam material of the cover plate and the marginal part, it will be appreciated that while a very light construction will be realized, a considerable stiffening of the upholstering body will be obtained in the region in which the end windings of the spring core engage the slot between the cover plate and the marginal part. Inasmuch as the stiffening bodies are located below the outer surface of the cover plate, they are cushioned by the cover plate and can hardly be felt at the outside of the upholstered body. Due to the upholstering of the stiffening bodies, it will also be avoided that a fabric cover surrounding the upholstering body can rub on the stiffening members and can thereby be worn. In view of the intermediate layer between the inner side of the cover plate and the pertaining surface of the spring core, it will be avoided that the cover plate can rub on the end windings of the spring core and thereby be damaged. The intermediate layer cannot be displaced relative to the cover plate inasmuch as it is fastened to the stiffening bodies. The stiffening bodies can be produced in a simple manner by mold-foaming while expediently at the same time the pressure elastic marginal part can be produced and of the same material as the latter the considerably more pressure-resistant stiffening bodies can be made. By changing the hardness and the volumetric weight of the foam for the cover plate and of the mold foam (Formschaum) for the marginal part, different elasticity values of the upholstered body can be realized.

The design according to the present invention is particularly suitable for mattresses employed in beds in which a foot section and/or a head section are adjustable to different inclined positions as is the general arrangement with hospital beds. The stiffening bodies located at the longitudinal sides of the mattress will when elevating the foot section or the head section prevent the mattress from buckling.

Figure 1:
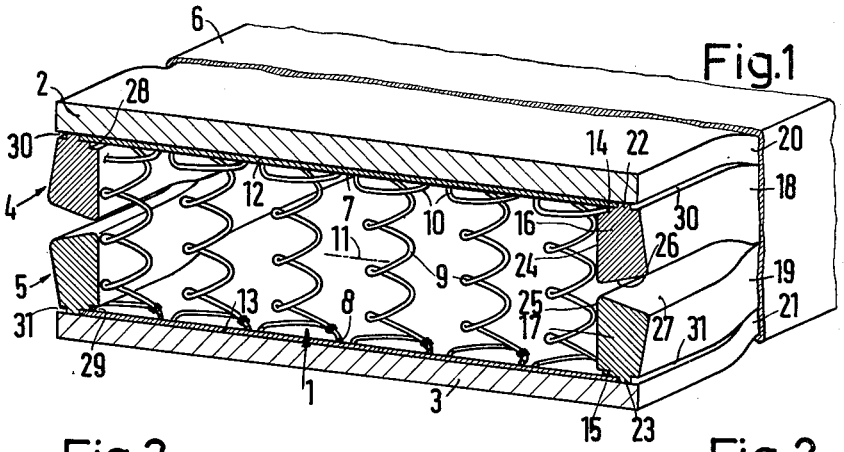

Referring now to the drawing in detail, the upholstered body designed as mattress and illustrated in FIG. 1, comprises a spring core 1 which has a parallelepiped basic block-shaped form and in top view has a longitudinal rectangular shape. The spring core 1 is covered by two intermediate layers 7,8, two cover plates 2,3, two marginal sections 4,5 and is furthermore covered by a fabric cover 6. The spring core 1 primarily consists of approximately axis-parallel springs 9 which are designed as helical springs and are bent of wire. The springs 9 are arranged in rows located at a right angle with regard to each other. For the sake of clarity, only one row of springs 9 of spring core 1 is shown in FIG. 1, said row being located at a right angle to the longitudinal sides of the spring core. The springs 9 respectively have two approximately plane annularly closed end windings 10 which in released condition of the spring core 1 are at the respective side located in a common plane which is parallel to the intermediate plane 11 of the upholstered body. The springs 9 are in a manner not illustrated in detail connected to each other for instance by helically bent wires. These wires are expediently parallel to the intermediate plane 11 and for instance engage the end windings 10 or engage windings of spring 9 which are located between said end windings. The wires, when seeing the spring core in top view, cross each other and are expediently located parallel to the outer edges of the upholstered body. In this way, the spring core forms a prefabricated unit closed in itself. The plane cover plates 2,3 are produced by cuts from plates which comprise an elastic synthetic foam and have a thickness of about from 15 to 30 mm, preferably 25 mm. The two identically designed cover plates 2,3 are greater than the basic shape of the spring core 1 so that they project beyond the circumference of spring core 1 by approximately the thickness of the marginal sections 4,5. The intermediate layers 7,8 which engage the inner sides and inner surfaces 12,13 of the cover plates 2,3 are considerably thinner than said cover plates and expediently consist of tear-resistant elastic soft and smooth material, for instance a needled (vernadelten) cotton fleece, a felt, synthetic form material or the like. The two longitudinal marginal portions 14,15 of each intermediate layer 7,8 are connected in the transition area between the pertaining cover plate 2,3 and the pertaining marginal portion 4,5 so that the intermediate layer cannot be displaced relative to the cover plate. Each marginal portion 4,5, has two parallel longitudinal sections 16,17, and at the narrow sides of the spring core 1 has two sections which are located at a right angle to the longitudinal sections 16,17 and form one piece with the longitudinal sections so that each marginal portion 4,5 has a rectangular frame shape. The marginal portions 4,5 which consist of pressure elastic synthetic foam and the pressure resistance of which may be greater than that of the cover plates 2,3 are at the inner sides of the cover plates 2,3 arranged in such a way that their outer longitudinal surfaces 18,19, after arrangement of the fabric cover 6 engage the respective sides of the upholstered body in a common plane and in the plane of the lateral surfaces 20,21 of the cover plates 2,3. The marginal portions 4,5 are connected by rod or strip-shaped stiffening bodies 22,23 to the inner sides 12,13 of cover plates 2,3. The stiffening bodies or stiffening members 22,23 which expediently form one piece with the respective pertaining marginal portions 4,5 and consist of foam material or the like extend in an uninterrupted manner over the entire circumference of the respective pertaining marginal portion 4,5 and thus likewise respectively form a frame. The stiffening bodies 22,23 are set back relative to the outer lateral surfaces 18,19 and also relative to the inner side surfaces 24,25 of the marginal portions 4,5, and thus can hardly be felt from the circumferential sides of the upholstered body. At the top surfaces of the upholstered body, the reinforcing members 22,23 are covered by the cover plates 2,3. The marginal portions 4,5 and the stiffening bodies or elements 22,23 may be fastened by gluing, cementing, welding or the like to cover plates 2,3. It is particularly expedient when the marginal portions 4,5 and stiffening members 22,23 are made by foaming out synthetic foam, especially cold foaming synthetic foam. A particularly simple manufacture is obtained when the respective marginal portion during the foaming process employed for its manufacture is adhesively connected to the pertaining cover plate 2,3 and the pertaining intermediate layer 7,8. For preparing the marginal portion 4,5, the cover plate 2,3 is with the intermediate layer 7,8 so arranged in a foaming mold that the zones intended for the connection of the marginal portion are located within the region of openings of the foaming mold. Each cover plate 2,3 together with the pertaining marginal portion 4,5 and the pertaining intermediate layer 7,8 forms a cover-like prefabricated hood which is post slipped onto spring core 1. The two hoods are located opposite to each other without a direct connection therebetween. Those plane longitudinal surfaces 26,27 of the two marginal portions 4,5 which face each other are in the relaxed condition of the spring core 1 located in spaced relationship to each other. Furthermore, the outer plane lateral surfaces 18,19 of the marginal portions 4,5 extend when the hood is in relaxed condition, at an incline relative to the respective pertaining cover plate 2,3 in such a way that in cross section they are inclined outwardly with regard to the free longitudinal surfaces 26,27. By means of the cover 6 of fabric material, for instance ticking, the spring core 1, the cover plates 2,3 and the marginal portions 4,5 are pre-tensioned at a right angle to the central plane 11. The marginal portions 4,5 will then have those of their longitudinal surfaces 26,27, which face each other, engage each other under pressure over their entire surface. Furthermore the marginal portions 4,5 are together with the cover 6 parallel to the intermediate plane 11 pre-tensioned toward the inside in such a way that their inner side surfaces 24,25 either without or only under a slight pressure engage the outer surfaces of the adjacent windings of those springs 9 which are located at the marginal portions of the spring core 1. The inner surfaces 24,25 will engage only those windings of springs 9 which are located between the end windings 10. The marginal portions 4,5 do not extend between said windings so that they cannot be damaged when the springs deform.

The marginal portions 4,5 are at least within the regions of two sections 16,17 which are located opposite to each other at their longitudinal sides which are located opposite the inner surfaces 12,13 of the cover plates 2,3, adjacent the stiffening bodies 23,22 offset in such a way that the slots 28,29 are formed for engagement by the end windings 10 of those springs 9 which are located at the marginal portion of the spring core 1. These end windings 10 have a diameter which is greater than that of the remaining windings. A lateral surface of the slots 28,29 the central planes of which extend parallel to the central plane 11 is formed by the respective pertaining intermediate layer 7,8 whereas the other side surfaces and the bottom surface are formed by the marginal portions 4 and 5 respectively. Expediently, the arrangement is such that the hardened or strengthened synthetic form which forms the stiffening bodies 23,22 extends into the region of the bottom surface as well as into the region of the lateral surface of slot 28,29 which lateral surface is formed by the intermediate layer 7,8 respectively. As a result thereof, this lateral surface as well as the bottom surface are formed by a relatively hard material, and a precise location of the respective hood and spring core 1 relative to each other is assured. The end windings 10 extend into the slots 28,29 only by an annular section the arc angle of which is less than 180°, for instance 90°. The depth of the slots 28,29, however, is greater than their width. In the relaxed condition of the hood, both lateral surfaces of slot 28,29 are located parallel to each other. If the marginal portions 4,5 with the fabric cover 6 are pre-tensioned in the above described manner parallel to the central plane 11, the lateral surface plate 2,3 will relative to the oppositely located lateral surface of slot 28,29 assume an inclined position so that it extends over the pertaining section of the end winding 10 of the respective spring 9 on the inner circumferential surface and at least approximately engages the intermediate layer 7,8.

The marginal portions 4,5 are also within the region of the outer side of the stiffening body 22,23 at that lateral side thereof which faces the cover plate 2,3 stepped or offset in such a way that open slots 30 and 31 respectively are formed on the circumference of the upholstered body. The longitudinal central plane of said slots are about parallel to the central plane 11. The slot 30,31, the width of which approximately equals that of slots 28,29 respectively is on one hand defined by the inner surface 12,13 of the cover plate 2,3 and on the other hand by the marginal portion 4,5. The hardened or stiffened synthetic foam of the stiffening body 22,23 respectively extends at best up to the bottom surface of slot 30,31 and does not form the side surfaces of said stiffening body. After the pre-tensioning of the upholstered body by the fabric cover 6, the lateral surfaces of slot 30,31 expediently engage each other so that the transition between the outer lateral surface 18,19 of the marginal portions 4,5 and of the surface 20,21 of cover plate 2,3 are free from gaps. The marginal portions of the intermediate layers 7,8 are relative to the outer longitudinal sides of the stiffening bodies 22,23, (which longitudinal sides form the bottom surface of slots 30,31,) offset inwardly so that the stiffening bodies 22,23 partially are directly with the respective pertaining cover plate 2,3, and partially through the intervention of the marginal portions 14,15 of the pertaining intermediate layer 7,8 connected to the cover plate 2,3.

Figure 2:
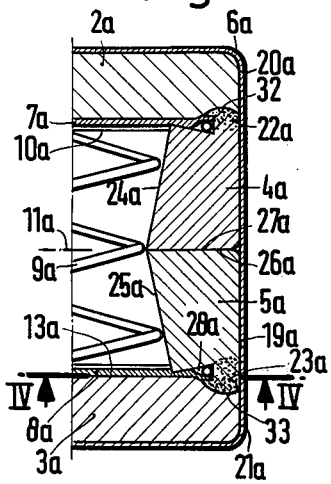
FIG. 2 shows in cross section a cutout of a modified upholstering body according to the invention.
Figure 4:
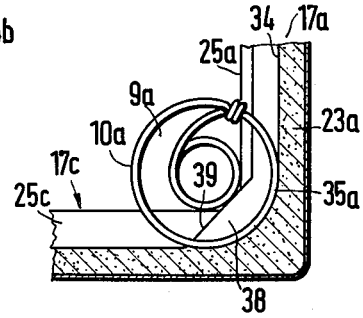
FIG. 4 represents a section along the line IV—IV of FIG. 2, but on a somewhat smaller scale than FIG. 2.

Those portions of FIGS. 2–4 which indicate the same parts of FIG. 1 are designated with the same reference numerals as in FIG. 1 but with the additional letter "*a*". The springs **9*a* of the upholstered body illustrated in FIGS. 2–4 taper from both end windings 10*a* toward the center of their length approximately conically in such a way that the intermediate winding will have the shortest diameter. The inner lateral surfaces 24*a*, 25*a* of the marginal portions 4*a*, 5*a* which increase in width toward their longitudinal surfaces 26*a*, 27*a*, are located at an incline to the central plate 11*a* in such a way that they will engage all pertaining springs 9*a* arranged between the end windings 10*a*. The stiffening bodies 22*a*, 23*a* engage the inner sides 12*a*, 13*a* of the cover plates 2*a*, 3*a* in such a way that they are partially embedded in the cover plates. Those connecting surfaces 32,33 of the stiffening bodies 22*a*, 23*a* which engage the inner sides of the cover plates 2*a*, 3*a* are cross section-wise curved convexly so that form material of the cover plates will be saved. The stiffening bodies 22*a*, 23*a* extend up to the outer lateral surfaces 18*a*, 19*a* of the marginal portions 4*a*, 5*a* and also extend up to the lateral surfaces 20*a*, 21*a* of the cover plates 2*a*, 3*a*. By "connecting surface" 32,33**, is to be understood the surface at which the marginal portion is connected to the cover plate.

As will furthermore be seen from FIG. 3, the marginal portion **14*a* of the intermediate layer 7*a*, which marginal portion is connected to the respective stiffening body 22*a*, is compressed to a thickness which is considerably less than the thickness of intermediate layer 7*a* in the remaining region which loosely engages the inner surface 12*a* of the cover plate 2*a*. The pressed-together marginal section 14*a* is permeated with the foam material of the stiffening body 22*a* and is thereby stiffened so that the marginal portion 14*a* forms a component of the stiffening body 22*a*. The marginal portion 14*a* which extends up to the bottom surface 34 of slot 28*a* has a width which is less than the depth of slot 28*a*. The width of marginal portion 14*a* approximately corresponds to the width of slot 28*a* in such a way that the sections 35 of the end windings 10*a* of the spring core, which sections 35 engage slot 28*a*, engage the marginal portion 14*a*. Directly from the marginal portion 14*a* on and from the sections 35 on, the intermediate layer 7*a* increases in thickness within the slot 28*a* so that the slot 28*a* will be narrowed toward that longitudinal side of slot 28*a* which faces away from the bottom surface 34. The stiffening body 22*a* extends on that side of slot 28*a*, which faces the cover plate 2*a*, only over that one portion of the width of the pertaining lateral surface 37 which is less than the width of the oppositely located lateral surface 36 of slot 28*a* so that a portion of the lateral surface 37 of slot 28*a* is not formed by the hard material of the stiffening body 22*a* but by the intermediate layer 7*a* and soft foam material of the cover plate 2*a*. The end windings 10*a* are also outside slot 28*a* pressed into the intermediate layer 7*a* so that the latter will in the engaging region of the end windings 10 be pressed together to a less thickness. As will be seen from FIG. 4, the respective marginal portion 5*a* is within the region of the corners of the upholstered body provided with corner extensions 38 which are located on the inside of the marginal portion, and which merge with the inner lateral surfaces 25*a*, 25*c* of the two sections 17*a*, 17*c* of marginal portion 5*a* which sections 17*a*, 17*c* are located at an angle relative to each other. The respective corner extension 38 comprises a plane inner surface 39 which is located at a right angle to the central plane 11*a* and forms one piece with the remaining marginal portion 5*a*. The inner surface 39 is located between the end windings 10*a* on the outer surfaces of the remaining windings of that spring 9*a* which is located within the region of the pertaining corner of the upholstered body. The extension 38 furthermore forms a widened continuation of the lateral surface 36 (FIG. 3) of slot 29*a* into which extends the end winding 10*a* with a section 35*a*, the arc angle of which approximately amounts to 180°. The bottom surface 34 of the slot (FIG. 3) is within the region of the corner extension 38 (FIG. 4) curved semi-circularly or over a quarter of a circle and is so adapted to the diameter of the end winding 10*a* that the latter nearly over its entire surface engages the curved section. Within the region of the corners of upholstered body, the stiffening bodies 22*a*, 23*a*** may be widened.

Those parts of FIG. 5 which correspond to the parts of FIGS. 1–4 are designated with the same reference numerals as in FIGS. 1–4, but with the index "*b*". The hood shown in section in FIG. 5 merely as a cutout, is similarly designed as the hoods according to FIG. 1. On the outside of the respective stiffening body **22*b* there is provided a slot 30*b* which in cross section extends only up to about the bottom surface of said slot 30*b* so that sections of the cover plate 2*b* and of the marginal portion 4*b* project beyond the outside of the stiffening body 22*b*. The marginal sections of the cover plate 2*b* and of the marginal portion 4*b* consist of pressure elastic soft foam material and form an upholstered cover for the stiffening bodies 22*b*** at the circumference of the upholstered body.

Expediently, slots 28,29 and 28*a*, 29*a* for the engagement of the end windings 10 of springs 9 are provided only on two sides located opposite to each other, namely the longitudinal sides of the upholstered body. The hoods within the region of the two other sides of the upholstered body are designed in conformity with FIG. 6. In FIG. 6, those parts which correspond to the parts of FIGS. 1–5 are designated with the same reference numerals as in FIG. 6 but with the index "*c*". The section 16*c* of the marginal part 4*c* is within the region of the stiffening body 22*c* relative to the embodiments of FIGS. 1–5 narrower by the depth of the slot to such an extent that its inner lateral surface 24*c* approximately continues up to the marginal area 14*c* of the intermediate layer 7*c*. Within the transition region toward the marginal portion 14*c*, the inner lateral surface 24*c* of the marginal portion 4*c* is in cross section expediently semicircularly curved concave with a radius which corresponds to about half the wire diameter of the end winding 10*c* so that the end winding is safely supported at said transition section. The lateral surfaces 18*c*, 24*c* of the section 16*c* of the marginal portion 4*c* diverge toward the free longtiudinal side of said marginal portion at a greater angle than the lateral surface of the sections 16, 16*a*, 16*b*, in such a way that this longitudinal side of section 16*c* has the same width as the free longitudinal surfaces of sections 16, 16*a*, 16*b*. The marginal portion 14*c* of the intermediate layer 7*c* extends up to the inner lateral surface 24*c* of the marginal portion 4*c* so that the end winding 10*c* can be supported at said marginal portion 4*c*.

As will be evident from FIG. 4, the inner lateral surface 25*c* of the section 7*c* of marginal portion 5*a* merges tangentially with the curved section of the bottom surface 34 of slot 29 and merges in an angled-off manner with the inner surface 39 of the corner extension 38. Also in the embodiment of FIG. 6, a slot corresponding to the slot 30*b* of FIG. 5 may be provided. Due to the fact that within the region of two sides of the upholstered body which sides are located opposite to each other, there are not provided any slots for engagement by the end winding 10c of the spring core, it is possible very easily to provide the hood on the spring core. The upholstered body is further stiffened by the corner extensions 38.

It is, of course, to be understood that the present invention is, by no means, limited to the specific showing in the drawing but also comprises any modifications within the scope of the appended claims.

What I claim is:

1. An upholstered body, especially mattress, which includes: a spring core comprising a plurality of rows of helical springs arranged in an axis-parallel manner with regard to each other, at least one cover plate means of elastic foamed material arranged in spaced axial relationship to and at least at one end of said springs while covering up the respective adjacent ends of all of said springs and projecting laterally and longitudinally beyond said spring core, marginal body means arranged on at least two oppositely located sides of said upholstered body, intermediate layer means interposed between said cover plate means and said springs, and the improvement in combination therewith which comprises bend-elastic bar-shaped stiffening means of set synthetic foam material arranged on and connected securely to said marginal body means and also having said intermediate layer means securely connected thereto as well as extending continuously only marginally entirely around the upholstered body in a homogeneous transition between the cover plate means and the marginal body means.

2. An upholstered body in combination according to claim 1, in which said stiffening means form lateral and bottom surfaces of slot means for engagement by adjacent end windings of said helical springs.

3. An upholstered body in combination according to claim 2, in which said intermediate layer means have marginal areas embedded in said stiffening means and together with said stiffening means from lateral surfaces on the inside of said slot means.

4. An upholstered body, especially mattress, which includes: a spring core comprising a plurality of rows of helical springs arranged in an axis-parallel manner with regard to each other, at least one cover plate means of elastic foamed material arranged in spaced axial relationship to and at least at one end of said springs while covering up the respective adjacent ends of all of said springs and projecting laterally and longitudinally beyond said spring core, marginal body means arranged on at least two oppositely located sides of said upholstered body, intermediate layer means interposed between said cover plate means and said springs, bend-elastic barshaped stiffening means arranged on and connected to said marginal body means and having said intermediate layer means connected thereto, corner sections located near said marginal body means, said marginal body means within the region of said corner sections respectively having extensions merging with the inner lateral surfaces of said corner sections forming portions of said marginal body means, and forming lateral surfaces opposite the respective adjacent cover plate means for engagement with end windings of those of said springs which are located at said corner sections.

5. An upholstered body according to claim 4, which includes a fabric cover enveloping said upholstered body, and in which the inner lateral surfaces of said marginal body means exclusively engage the mantle surfaces of those of said springs which are located at the marginal areas of said spring core, said last mentioned spring preloading said fabric cover.

6. An upholstered body according to claim 4, in which said stiffening means respectively form one single entity with the respective adjacent marginal body means.

7. An upholstered body according to claim 4, in which said stiffening means are embedded in the innerside of the adjacent cover plate means and connected thereto.

8. An upholstered body, especially mattress, which includes: a spring core comprising a plurality of rows of helical springs arranged in an axis-parallel manner with regard to each other, at least one cover plate means of elastic foamed material arranged in spaced axial relationship to and at least at one end of said springs while covering up the respective adjacent ends of all of said springs and projecting laterally and longitudinally beyond said spring core, marginal body means arranged on at least two oppositely located sides of said upholstered body, intermediate layer means interposed between said cover plate means and said springs, bend-elastic bar-shaped stiffening means arranged on and connected to said marginal body means and having said intermediate layer means connected thereto, said stiffening means forming lateral and bottom surfaces of slot means for engagement by adjacent end windings of said helical springs, said intermediate layer means having marginal areas embedded in said stiffening means and together with said stiffening means forming lateral surfaces on the inside of said slot means, said marginal areas of said intermediate layer means forming a compacted thinner section than the remaining portion of said intermediate layer means and being permeated with the synthetic foam material of said stiffening means.

9. An upholstered body according to claim 8, in which said stiffening means in cross-sectional direction extend about to that lateral surface of said slot means which is located opposite the respective adjacent cover plate means.

10. An upholstered body according to claim 8, in which that surface of said stiffening means which faces toward the outside of the respective adjacent cover plate means in cross-sectionwise curved convexly.

11. An upholstered body according to claim 4, in which said stiffening means extend uninterrupted in a frame-like manner around said spring core.

* * * * *